US005601648A

United States Patent [19]

Freisberg et al.

[11] Patent Number: 5,601,648

[45] Date of Patent: Feb. 11, 1997

[54] APPARATUS FOR APPLYING TREATING LIQUOR TO A TRAVELING TEXTILE WEB

[75] Inventors: Helge Freisberg, Monchen-Gladbach; Peter Mevissen, Erkelenz, both of Germany

[73] Assignee: A. Monforts GmbH & Co., Monchen-Gladbach, Germany

[21] Appl. No.: 104,188

[22] Filed: Aug. 9, 1993

[30] Foreign Application Priority Data

Aug. 7, 1992 [DE] Germany ..... 42 26 170.8

[51] Int. Cl.[6] ..... B05C 3/12

[52] U.S. Cl. ..... 118/419; 118/405; 118/407; 118/414; 118/420; 118/423; 118/424; 118/427

[58] Field of Search ..... 118/405, 407, 118/414, 419, 420, 423, 424, 427

[56] References Cited

U.S. PATENT DOCUMENTS

| | | | |
|---|---|---|---|
| 2,603,077 | 7/1952 | Dungler | 118/405 X |
| 2,884,893 | 5/1959 | Kabelitz | 118/420 X |
| 2,905,522 | 9/1959 | Fahringer | 118/405 X |
| 2,964,825 | 12/1960 | Cocker, III | 118/414 |
| 3,073,713 | 1/1963 | Brodeur | 118/420 X |
| 3,168,414 | 2/1965 | Fleissner | 118/419 X |
| 3,449,156 | 6/1969 | Brown | 118/427 X |
| 3,763,671 | 10/1973 | Schiffer et al. | 118/419 x |
| 3,826,228 | 7/1974 | Glover | 118/255 |
| 4,449,476 | 5/1984 | Voswinckel et al. | 118/674 |
| 4,506,526 | 3/1985 | Kutz et al. . | |
| 4,565,155 | 1/1986 | Koski | 118/412 |

FOREIGN PATENT DOCUMENTS

| | | |
|---|---|---|
| 1410845 | 5/1972 | Germany . |
| 3415677 | 10/1985 | Germany . |

*Primary Examiner*—James C. Housel
*Assistant Examiner*—Harold Y. Pyon
*Attorney, Agent, or Firm*—Shefte, Pinckney & Sawyer

[57] ABSTRACT

An apparatus for applying treating liquor to a traveling textile web having a vat containing treating liquor and a plurality of web guiding rolls submerged in the treating liquor and arranged in a substantially vertical sequence with adjacent rolls being in contact to form nips therebetween. The upper rolls are supported in the vat for resting under their own weight on the lower roll to apply pressure at the nips on the textile web. A drive motor drives at least one of the rolls with the other rolls being driven by surface contact with the drive roll for positive feed of the traveling web at a uniform surface speed through the treating liquor. Guide rolls guide the textile web to the vat at substantially the same surface speed as that of the plurality of rolls. A pair of driven squeeze rolls above the treating liquor form a nip through which the textile web is guided as it travels from the treating liquor, with squeeze rolls being driven at substantially the same surface speed as the guide rolls.

7 Claims, 2 Drawing Sheets

APPARATUS FOR APPLYING TREATING LIQUOR TO A TRAVELING TEXTILE WEB

FIELD OF THE INVENTION

The invention relates to an apparatus for applying treating liquor to a traveling textile web and, more particularly, for achieving uniform surface speed of the web in such an apparatus.

BACKGROUND OF THE INVENTION

Apparatus for applying a treating liquor to a traveling textile web in a vat are well known. To ensure desired impregnation of treating liquor, such as dye, coating material, or the like, into the interstices of the textile web in a vat, at least one guide roll is typically placed above a lowermost roll in the vat to form a nip for applying pressure to the web as it travels therethrough. The upper guide rolls may be vertically displaceable in bearings to rest under their own weight on the lowermost roll, particularly in connection with relatively thick material. The rolls are not positively driven but, rather, are driven by the pull of the textile web traveling around the rolls. Typically, a textile web is inserted from the top of the vat into the liquor, guided around a lowermost roll, around the other rolls through the nips, and to squeeze rolls disposed above the vat.

Problems occur during the operation of such existing apparatus with a textile web which is longitudinally extendable, such as knit goods. One problem occurs because of the drag imposed on the textile web caused by pulling the undriven rolls, which causes longitudinal extension of the textile web and also produces corresponding reduction in the width of the fabric web

SUMMARY OF THE INVENTION

The present invention provides an apparatus for applying treating liquor to a traveling textile web in a manner that substantially eliminates the drag on the web so that there is little or no resulting longitudinal extension of the web as it travels through the apparatus.

Briefly described, the apparatus for applying liquor to a traveling textile web of the present invention includes a vat containing treating liquor with a plurality of web guiding rolls submerged in the treating liquor and arranged in a substantially vertical sequence with adjacent rolls being in contact to form a nip therebetween. The rolls are arranged for guiding the textile web down into the treating liquor, under the lowermost roll of the vertical sequence of rolls, through the nip of adjacent rolls, and then away from the treating liquor. The upper roll of adjacent rolls of the plurality of web guiding rolls is supported in the vat for resting under its own weight on the lower adjacent roll to apply pressure at the nip on the textile web traveling therethrough, and drive means are provided for driving at least one of the rolls of the plurality of guide rolls with at least one other roll of the plurality of rolls being driven by surface contact with an adjacent roll for positive feed at a uniform surface speed of the textile web through the treating liquor.

preferably, the plurality of web guiding rolls includes three rolls forming two nips with lowermost and intermediate rolls forming one pair of adjacent rolls and the intermediate and uppermost roll forming another pair of adjacent rolls with pressure nips between the rolls of each pair of adjacent rolls.

In the preferred embodiment, at least one driven roll has a drive sprocket attached thereto and the drive means includes a toothed drive belt drivingly engaging the drive sprocket for driving the driven roll.

Also, the preferred embodiment includes means for transporting the textile web to the vat at substantially the same surface speed as that of the plurality of rolls and includes a pair of driven squeeze rolls above the treating liquor and forming a nip through which the textile web is guided as it travels from the treating liquor, with the squeeze rolls being driven at substantially the same surface speed as the plurality of guide rolls.

DESCRIPTION OF THE PREFERRED EMBODIMENT

Figure 1:
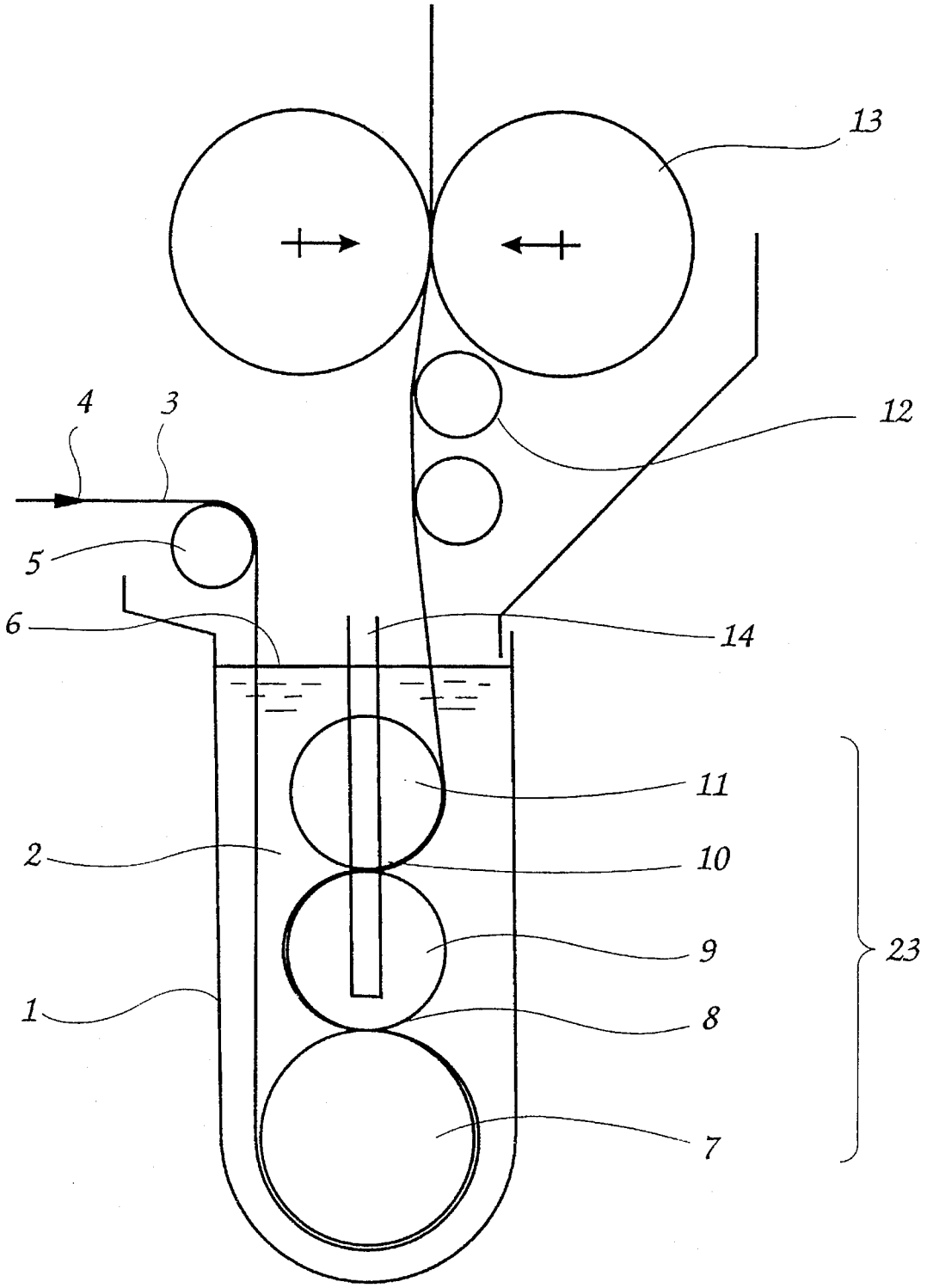
FIG. 1 is a schematic vertical sectional view of an apparatus for applying treating liquor to a traveling textile web according to the preferred embodiment of the present invention.

The illustrated preferred embodiment of the present invention includes a vat 1, in which a treating liquor 2 is contained. A textile web 3, which may be longitudinally extendable, such as a knitted material, is conveyed in the transport direction 4 across an inlet guide roll 5 into the treating liquor 2, below the liquor level 6 around a lowermost submerged guide roll 7, through a first nip 8 between the lowermost roll 7 and an intermediate roll 9 around the intermediate guide roll 9, and through a second nip 10 between the intermediate roll 9 and an uppermost roll 11, partially around the uppermost roll 11, out of the treating liquor 2, over a pair of spaced spacer rollers 12, and through the nip of a pair 13 of squeeze rolls that are biased against each other in the direction of the illustrated arrows. The intermediate and uppermost web guide rolls 9,11 rest under their own weight on the lowermost roll 7 to apply pressure at the respective nips 8,10, on the textile web traveling therethrough, and are restrained horizontally but freely movable in a vertical slotted bearing support 14. The lowermost roll 7, the intermediate roll 9, and the uppermost roll 11 constitute a plurality of submerged rolls 23.

In accordance with the present invention, at least one of the submerged rolls is driven by drive means in the form of a conventional drive motor 19. The drive motor 19 acts through a toothed drive belt 17 or the like trained around a sprocket 19 attached to one of the submerged rolls 23 for driving the submerged rolls preferably, the lowest roll 7 of the submerged plurality of rolls 23 has the sprocket 19 attached to it for driving thereby. Because of the bearing pressure of the other rolls against the lowermost roll, they are driven thereby and rotate at the same surface speed as the driven lowermost roll 7. Under certain circumstances it could be advantageous to drive the intermediate roll 9 or the uppermost roll 11 because in such embodiments the power losses as a whole become slightly less as the toothed belt 17 would be submerged a lesser distance. In such arrangement, the belt 17 would drivingly engage a sprocket 20 or 21 attached to the intermediate roll 9 or the uppermost roll 11, respectively.

It is advantageous that the drive acts from outside the vat 1 by the belt transmission into vat 1, as the vat 1 can be lowered away from the rolls or the assembly of rolls raised for threading in of new material, cleaning, or maintenance, without disassembly of the rolls and their drive. In regard to the drive being below the level 6 of the liquor 2, it is only necessary to ensure that the drive sprocket 18 of the motor 19 and the roll sprockets 16, 20, and 21, as well as the toothed belt 17, are made of a material and are seated in such a way that an undisturbed submerged operation is possible. Moreover, the upper ones of the submerged rollers 23 can be embodied or seated so that they can be lifted away from each other for the threading process.

Figure 2:
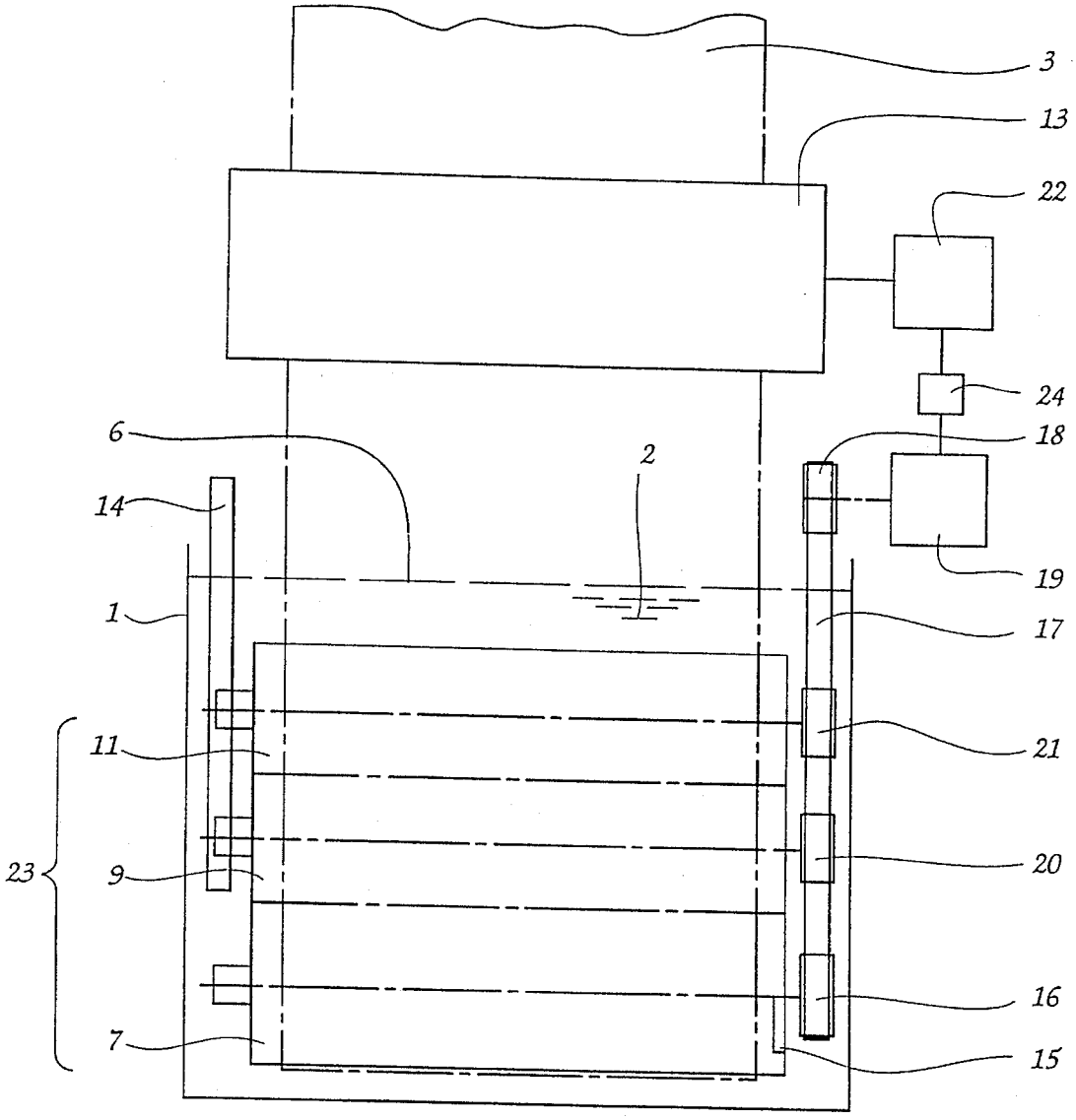
FIG. 2 is a schematic vertical sectional view of the apparatus of FIG. 1 as viewed transverse thereto.

In accordance with FIG. 2, the squeeze rolls 13 are driven by a drive motor 22. The motor 19 for the submerged rolls 23, and the drive motor 22 for the squeeze rolls 13 may be controlled via a conventional controller 24. Preferably, the system is controlled such that the textile web 3 is neither stretched tightly in the area between the submerged rolls 23 and the squeeze rolls 13 nor hangs too loosely. This is accomplished by setting the conveying speed of the submerged rolls at essentially the same speed as the preset transporting speed of the textile web. In further accordance with the preferred embodiment of the invention, the drive is controlled in such a way that the conveying speed of the textile web through the submerged rolls on the average is as great as that through the nip of the squeeze rolls. Thus, the associated control 24 preferably assures that the textile web is neither stretched tightly between the submerged rolls and the squeeze rolls nor that it hangs so loosely that the movement of the textile web is disturbed.

In summary, it is possible to treat longitudinally extendable textile webs in a vat treating apparatus in which the web travels over a submerged series of rolls without the disadvantage of stretching. Further, the treated textile web is conveyed through the submerged apparatus without applying a tensile force for pulling it out or leading it around the submerged rolls. Using the apparatus, it is possible without problems to impregnate the treating liquor into the interstices of textile webs which are extendable, particularly knitted material and relatively thick, without it being necessary to exert disruptive longitudinal tension on the textile web.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. An apparatus for applying treating liquor to a traveling textile web comprising:

(a) a vat containing treating liquor;

(b) at least three web guiding rolls submerged in the treating liquor in said vat and arranged in a substantially vertical sequence with adjacent rolls being in contact to form nips therebetween, said rolls being arranged for guiding the textile web down into the treating liquor, under the lowermost roll of said vertical sequence of rolls, through the nips adjacent rolls and then away from the treating liquor;

(c) the upper roll of said adjacent rolls being supported in said vat for resting under its own weight on the next lower of said adjacent rolls to apply pressure at the nip on the textile web traveling therethrough; and (d) drive means for driving at least one of the rolls of said plurality of rolls with at least one other roll of said plurality of rolls being driven by surface contact with an adjacent roll for positive feed at a uniform surface speed of the textile web through the treating liquor to substantially prevent the longitudinal stretching of the textile web.

2. An apparatus for applying treating liquor according to claim 1 wherein said at least one driven roll has a drive sprocket attached thereto and said drive means includes a toothed drive belt drivingly engaging said drive sprocket for driving said at least one driven roll thereby.

3. An apparatus for applying treating liquor according to claim 1 wherein said three guiding rolls form two nips with lowermost and intermediate rolls forming one pair of said adjacent rolls and the intermediate and uppermost roll forming another pair of said adjacent rolls with pressure nips between the rolls of each pair of adjacent rolls.

4. An apparatus for applying treating liquor to a traveling textile web according to claim 3 wherein said driven roll is one of said intermediate roll and said upper roll.

5. An apparatus for applying treating liquor according to claim 1 and further comprising means for transporting the textile web to the vat at substantially the same surface speed as that of said plurality of rolls.

6. An apparatus for applying treating liquor according to claim 5 and further comprising a pair of driven squeeze rolls above said treating liquor and forming a nip through which the textile web is guided as it travels from the treating liquor and means for driving said pair of driven squeeze rolls at substantially the same surface speed as said plurality of guide rolls.

7. An apparatus for applying treating liquor to a traveling textile web comprising:

(a) a vat containing treating liquor;

(b) a plurality of web guiding rolls submerged in the treating liquor in said vat and arranged in substantially vertical sequence with adjacent rolls being in contact to form a nip therebetween, said rolls being arranged for guiding the web down into the treating liquor, under the lowermost roll of said vertical sequence of rolls, through the nip of adjacent rolls, and then away from the treating liquor;

(c) first drive means for driving at least one of the rolls of said plurality of rolls;

(d) at least two squeeze rolls disposed above said treating liquor and forming a nip through which the textile web is guided as it travels from the treating liquor;

(e) second drive means for driving at least one of said squeeze rolls; and (f) control means for maintaining the drive speed of said first and second drive means substantially equal to one another and substantially equal to a predetermined web travel rate for maintaining the web taut and substantially unstretched to prevent substantial longitudinal stretching of the web and to prevent the web from hanging loosely intermediate said submerged web guiding rolls and said squeeze rolls.

* * * * *